US006453983B1

(12) United States Patent
Schelte et al.

(10) Patent No.: US 6,453,983 B1
(45) Date of Patent: Sep. 24, 2002

(54) DEVICE AND METHOD FOR CASTING METAL STRIPS, ESPECIALLY STEEL, IN DOUBLE ROLLER CONTINUOUS CASTING MACHINES

(75) Inventors: Meinolf Schelte, Igensdorf; Franz Fikus, Frankfurt, both of (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/380,228

(22) PCT Filed: Feb. 17, 1998

(86) PCT No.: PCT/DE98/00448

§ 371 (c)(1),
(2), (4) Date: Jan. 12, 2000

(87) PCT Pub. No.: WO98/37996

PCT Pub. Date: Sep. 3, 1998

(30) Foreign Application Priority Data

Feb. 28, 1997 (DE) ..... 197 08 276

(51) Int. Cl.[7] ..... B22D 11/06; B22D 27/02
(52) U.S. Cl. ..... 164/428; 164/503; 164/467
(58) Field of Search ..... 164/428, 503, 164/467

(56) References Cited

U.S. PATENT DOCUMENTS 4,974,661 A * 12/1990 Lari et al. ..... 164/503
4,982,796 A * 1/1991 Lari et al. ..... 164/467
5,197,534 A * 3/1993 Gerber ..... 164/467
5,251,685 A * 10/1993 Praeg ..... 164/467
5,273,103 A * 12/1993 Tolve et al. ..... 164/502
5,836,376 A * 11/1998 Matsui et al. ..... 164/466
5,848,635 A * 12/1998 Aoi et al. ..... 164/467
6,152,210 A * 11/2000 Baharis et al. ..... 164/502

FOREIGN PATENT DOCUMENTS

| | | |
|---|---|---|
| DE | 195 38 012 | 4/1996 |
| DE | 44 38 119 | 5/1996 |
| DE | 195 12 458 | 10/1996 |
| RU | 1764784 | * 4/1989 |

OTHER PUBLICATIONS

Saucedo, Ismael G. and Blazek, Kenneth E., Development of an Electromagnetic Edge Dam for Twin Roll Casting, Jul., 1994, Inland Steel Research and Development.

* cited by examiner

*Primary Examiner*—M. Alexandra Elve
*Assistant Examiner*—Len Tran
(74) *Attorney, Agent, or Firm*—Baker Botts L.L.P.

(57) ABSTRACT

A device for casting strips of metal, in particular steel, in twin-roll continuous casting machines having counter-rotating casting rolls. Liquid metal is fed into a space bound by two side walls, between the rotating casting rolls. The gaps, which are formed between the side walls. The rotating casting rolls are sealed by a sealing device for generating electrodynamic forces, that, following the gap profile, act essentially parallel to the casting-roll surface. The sealing device is constructed so as to continuously adapt the electrodynamic forces to the metallostatic pressure or approximately to the metallostatic pressure of the liquid metal.

19 Claims, 7 Drawing Sheets

A - A

C-C

D-D

DEVICE AND METHOD FOR CASTING METAL STRIPS, ESPECIALLY STEEL, IN DOUBLE ROLLER CONTINUOUS CASTING MACHINES

FIELD OF THE INVENTION

The present invention relates to a device and a method for casting strips of metal, in particular steel, in twin-roll continuous casting machines with counter-rotating casting rolls. Liquid metal is fed into a space, bounded by two side walls, between the rotating casting rolls, and liquid metal is prevented from flowing out from gaps that form between the side walls and the casting rolls. The present invention also relates to a device for carrying out the method.

BACKGROUND INFORMATION

U.S. Pat. Nos. 4,974,661 and 5,197,534 describe methods and devices for the electrodynamic sealing of the side regions of twin-roll casting machines. In the procedure described in these U.S. Patents, magnetic fields are used for the electrodynamic sealing, these fields act over the width of the filling space of the liquid metal and keep the metal away from the side wall over this width. The disadvantages of the conventional methods are that the necessary coil systems are very costly and the currents needed are quite substantial. The installed electric power per seal is 300–500 kW. Further details and characteristic curves of the conventional systems is described in the article: Development of an Electromagnetic Edge Dam (EMD) for Twin Roll Casting, I. G. Sancedo and K. E. Blazek, Metec Conference, Dusseldorf, June 1994, Inland Steel Research and Development.

SUMMARY OF THE INVENTION

An object of the present invention is to provide a method and a device featuring substantially lower energy consumption, accompanied by improved adjustability (avoidance of local overheating). Another object is to avoid eddies in the liquid metal that are caused by the sealing. In addition, it is desirable for the sealing device to be markedly smaller and thus more cost-effective than the conventional devices.

The objective is achieved in a device for casting strips of metal with a sealing device that, the sealing device adapts the electrodynamic forces continuously to the metallostatic pressure or approximately to the metallostatic pressure of the liquid metal. In this way, eddying in the liquid metal is avoided. In addition, local overheating is prevented.

In one advantageous embodiment of the present invention, the sealing device is curved in such a way that its distance from the casting rolls increases with increasing height, in particular its distance increases in such a way that, due to the increase in the air gap, magnetic field forces are produced that become weaker and correspond to the metallostatic pressure of the liquid metal which decreases upward.

In a further advantageous embodiment of the present invention, the sealing device has a current-carrying inductor, designed, for example in one piece. The one-piece design has proven especially successful in conjunction with a Y-shaped inductor with two curved branches and a base. In the region where the branches and base are interconnected, the inductor advantageously has a bend configured so that the distance between the casting rolls and the inductor increases with increasing distance from the bend upward and downward. In this way, the forces, caused by the magnetic field are adapted in a suitable manner to the metallostatic pressure of the liquid metal. The forces caused by the magnetic field can be adjusted precisely to the metallostatic pressure if the inductor, in an alternative form to the bent design, is curved in a longitudinal direction, the region in which branches and base meet one another being closest to the casting rolls, and the distance from the casting rolls increases with increasing distance from the part at which branches and base meet.

In a further advantageous embodiment of the present invention, the sealing device has a "magnetic shoe" made of magnetizable material. The magnetic shoe is arranged so that the electrodynamic forces are adapted continuously to the metallostatic pressure or approximately to the metallostatic pressure of the liquid metal. The magnetic shoe is particularly suitable for adapting the forces caused by the magnetic field to the metallostatic pressure. It represents an alternative to the bent inductor, but may also be used in conjunction with bent inductor. The magnetic shoe is advantageously V-shaped or Y-shaped, the amount of magnetizable material advantageously decreasing in the direction of the ends of the magnetic shoe. The magnetic shoe is advantageously arranged directly on the inductor, so that it is cooled by the coolant that cools the inductor.

In another advantageous embodiment of the present invention, magnetizable material is arranged at the edges of the inductor, so that the current flowing through the inductor is utilized particularly well in relation to the desired magnetic field, and a lower current is necessary through the inductor.

In a further advantageous embodiment of the present invention, the interspace between the sealing device and the liquid metal is traversed by inert gas, example nitrogen, whereby the sealing device is insulated thermally from the liquid metal.

DETAILED DESCRIPTION

Figure 1:
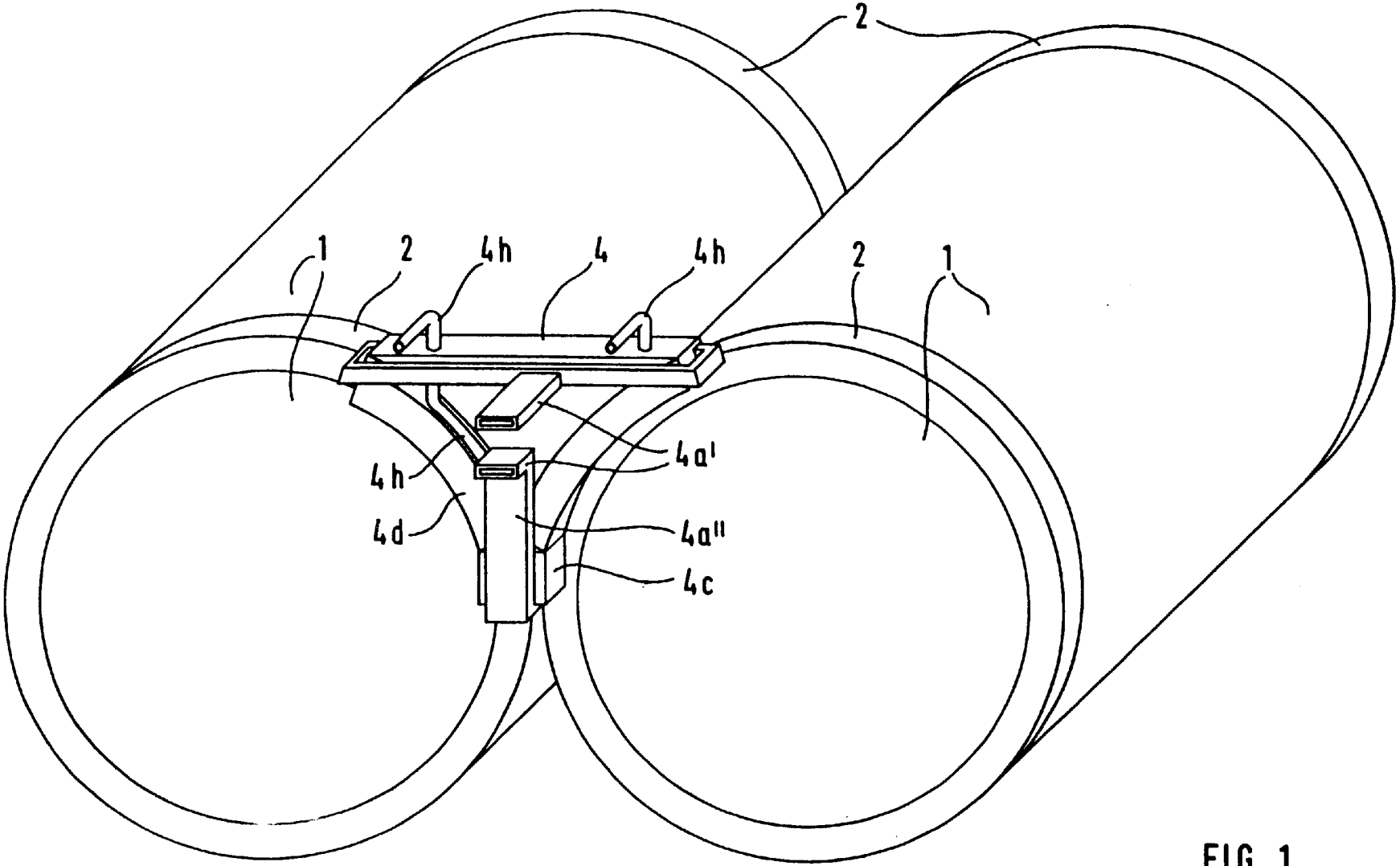
FIG. 1 shows a three dimensional sketch of casting rolls with magnetic rings and an inductor according to the present invention.
Figure 2:
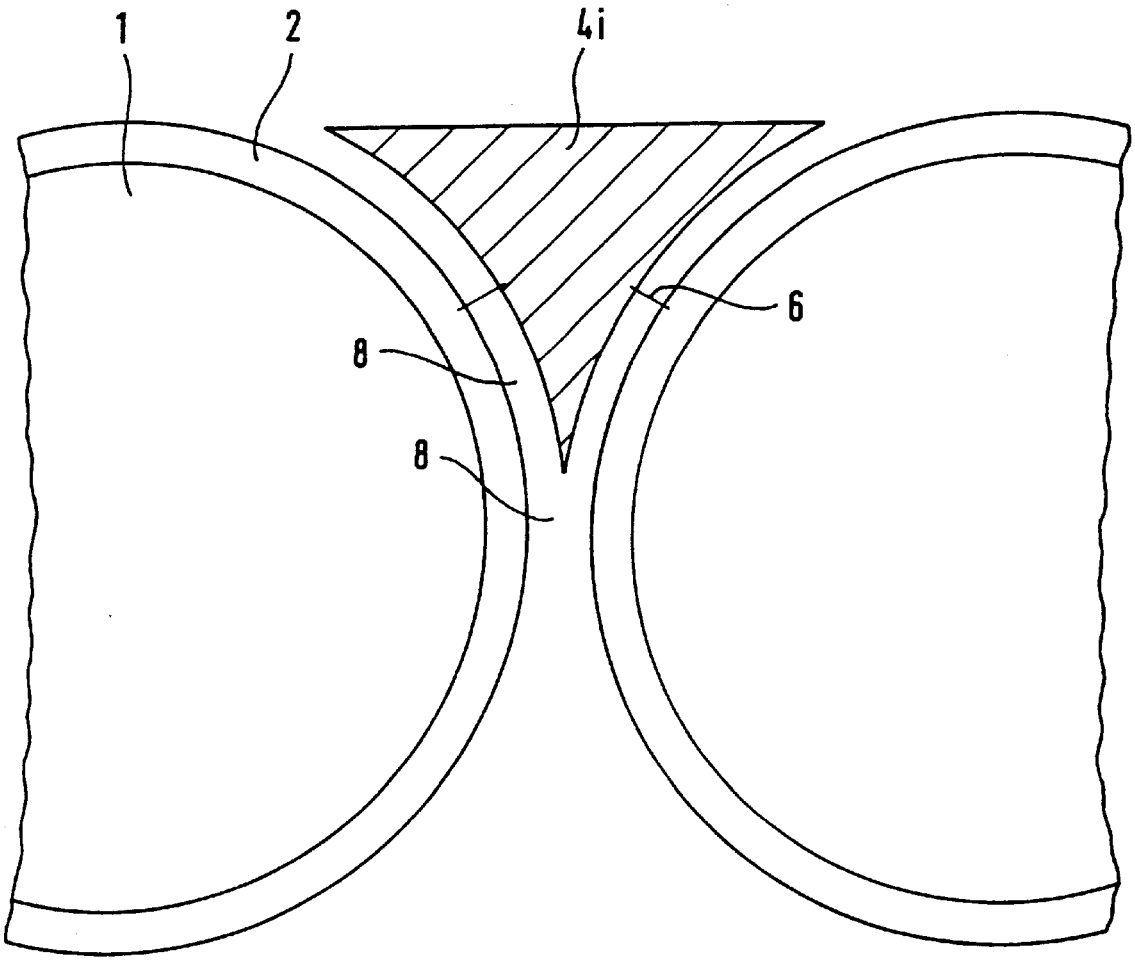
FIG. 2, shows a simplified schematic of a sealing device according to the present invention.
Figure 2:
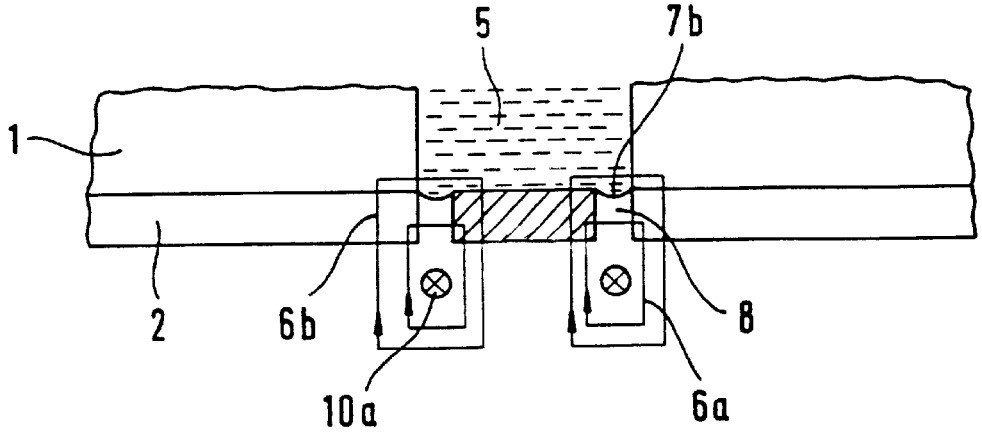

In the exemplary embodiment shown in FIGS. 1 and 2. the sealing device of the present invention has, inter alia,

- a magnetic end ring 2, that is fastened to casting-roll end 1;
- an inductor 4 that is fed with medium-frequency current and produces a correspondingly large magnetic field 6 in sealing gap 8; and
- a magnetic shield 11 that protects the steel components of the casting machine against damaging heating.

Figure 7:
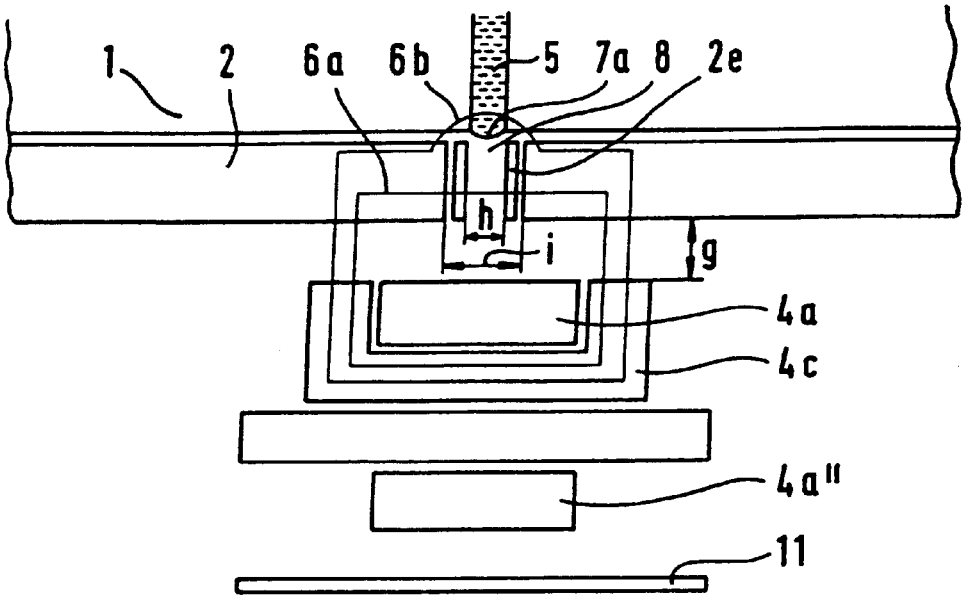
FIG. 7 shows a cross-section C—C of the roll end and the sealing device as shown in FIG. 6.
Figure 8:
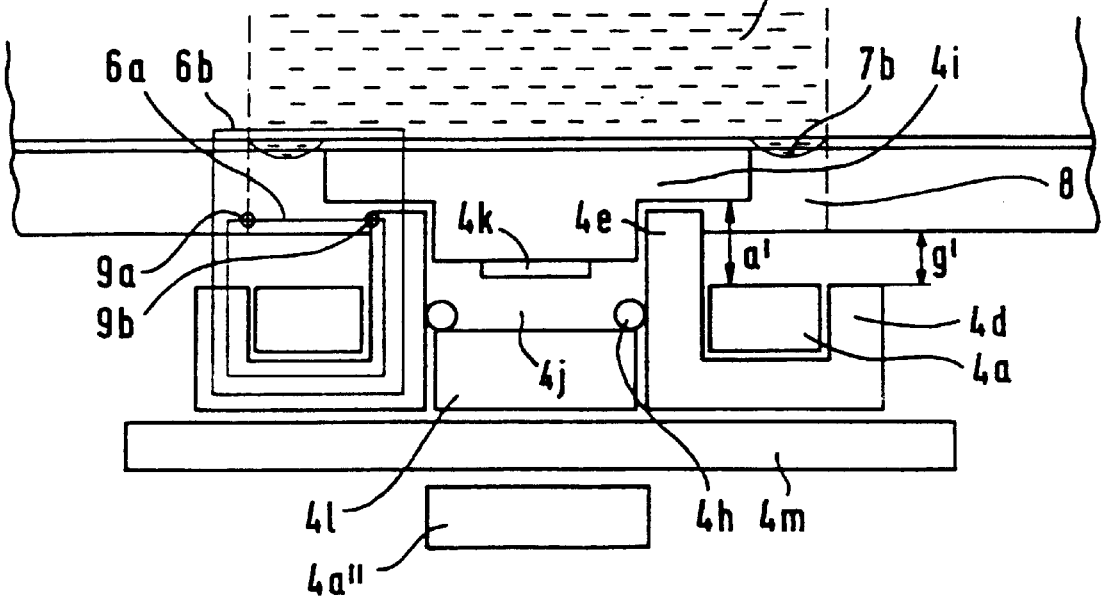
FIG. 8 shows a cross-section D—D of the roll end and the sealing device shown in FIG. 6.

The object of the sealing device is to drive back the liquid metal in sealing gap 8 without contact. The aim is liquid-metal menisci 7*a* and 7*b,* as shown in FIGS. 7 and 8. These are achieved when the hydrostatic, that is to say in the present case, the metallostatic pressure of the liquid metal $p_1$ (FIG. 3) is counteracted by a suitably greater electrodynamic force $p_2$. Electrodynamic force $p_2$ occurs as a result of an interaction between split magnetic field 6*b* and a current induced in the meniscus.

Main magnetic field 6*a* causes sealing channel 8 to remain generally free of liquid metal over length a of casting-roll magnetic end ring 2 (FIG. 2). As a result, the liquid metal is set back with respect to the heat-sensitive inductor. Sealing channel 8, free of liquid metal, can also be advantageously traversed a length of cooling inert gas.

Figure 4:
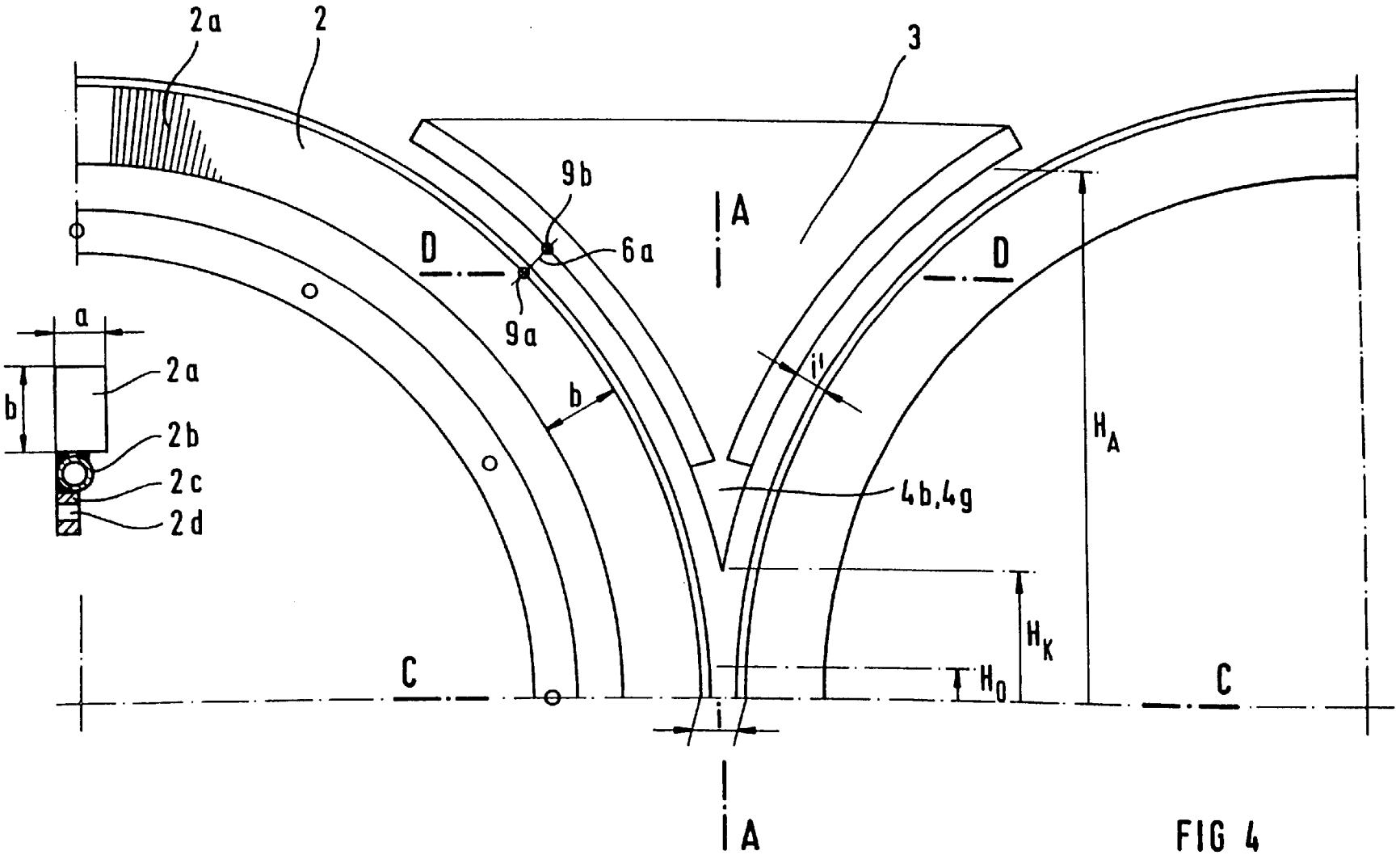
FIG. 4 shows a detailed schematic of the sealing device according to the present invention.

Casting-roll magnetic end ring 2 according to FIG. 4 has radially arranged, for example, rectangular, and thin (e.g., 0.1 mm thick) magnetic laminations 2*a*. Magnetic laminations 2*a* are secured to, e.g. soldered onto, cooling ring 2*b*. Casting-roll magnetic end ring 2 is fastened to the end of casting roll 1, for example with the aid of screws, which are fitted in bore holes 2*d* of fastening ring 2*c*. The depth of sealing channel 8 is determined by length a of casting-roll magnetic end ring 2, for example a=20 mm.

The laminate stack composed of magnetic laminations 2*a* is insulated on all sides, for example, using a ceramic layer applied by plasma spraying.

Located over magnetic laminations 2*a* is a protective ring 2*e,* which protects the laminations from any liquid metal that may possibly splash out.

Figure 5:
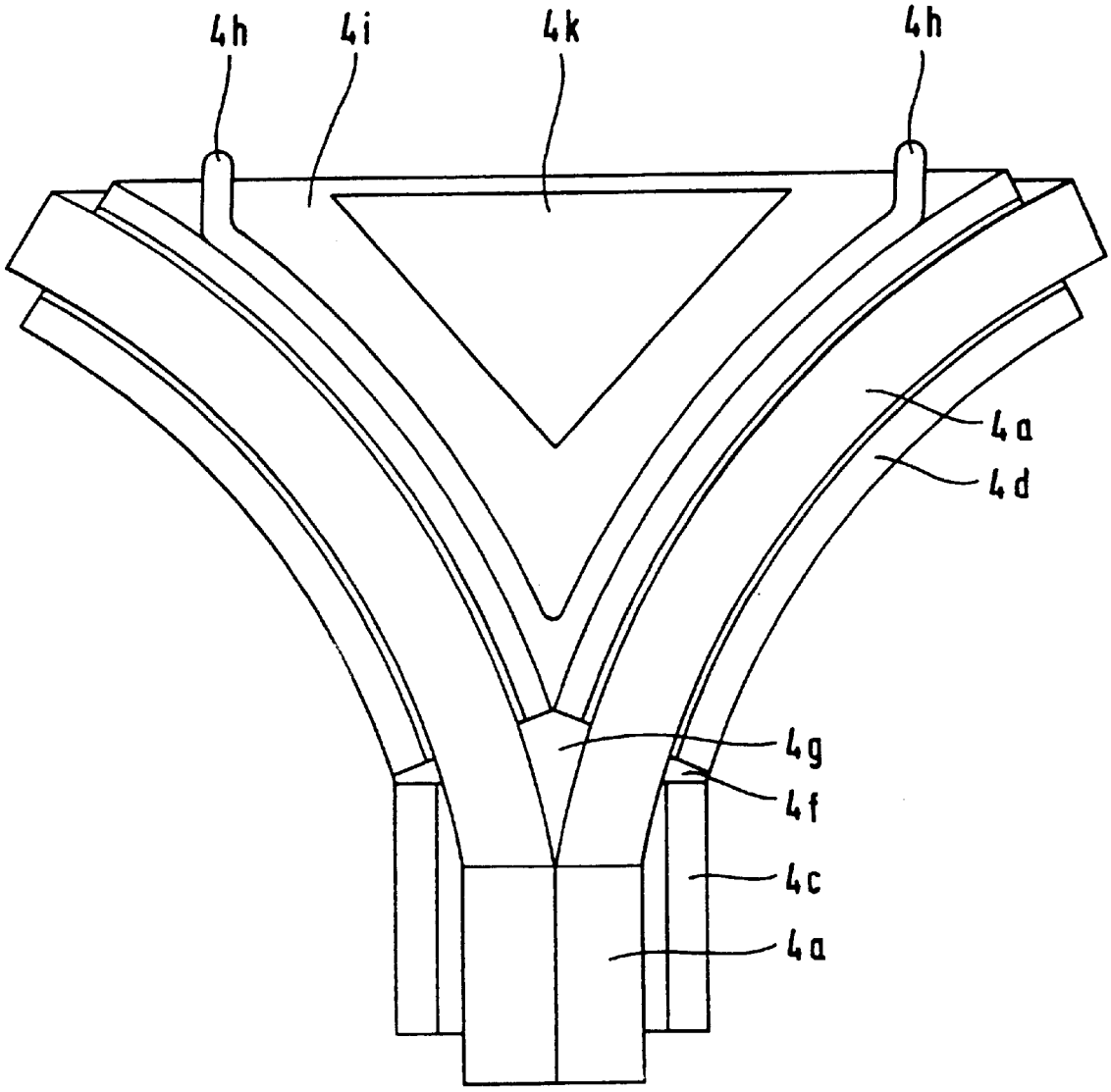
FIG. 5 shows an inductor according to the present invention.
Figure 6:
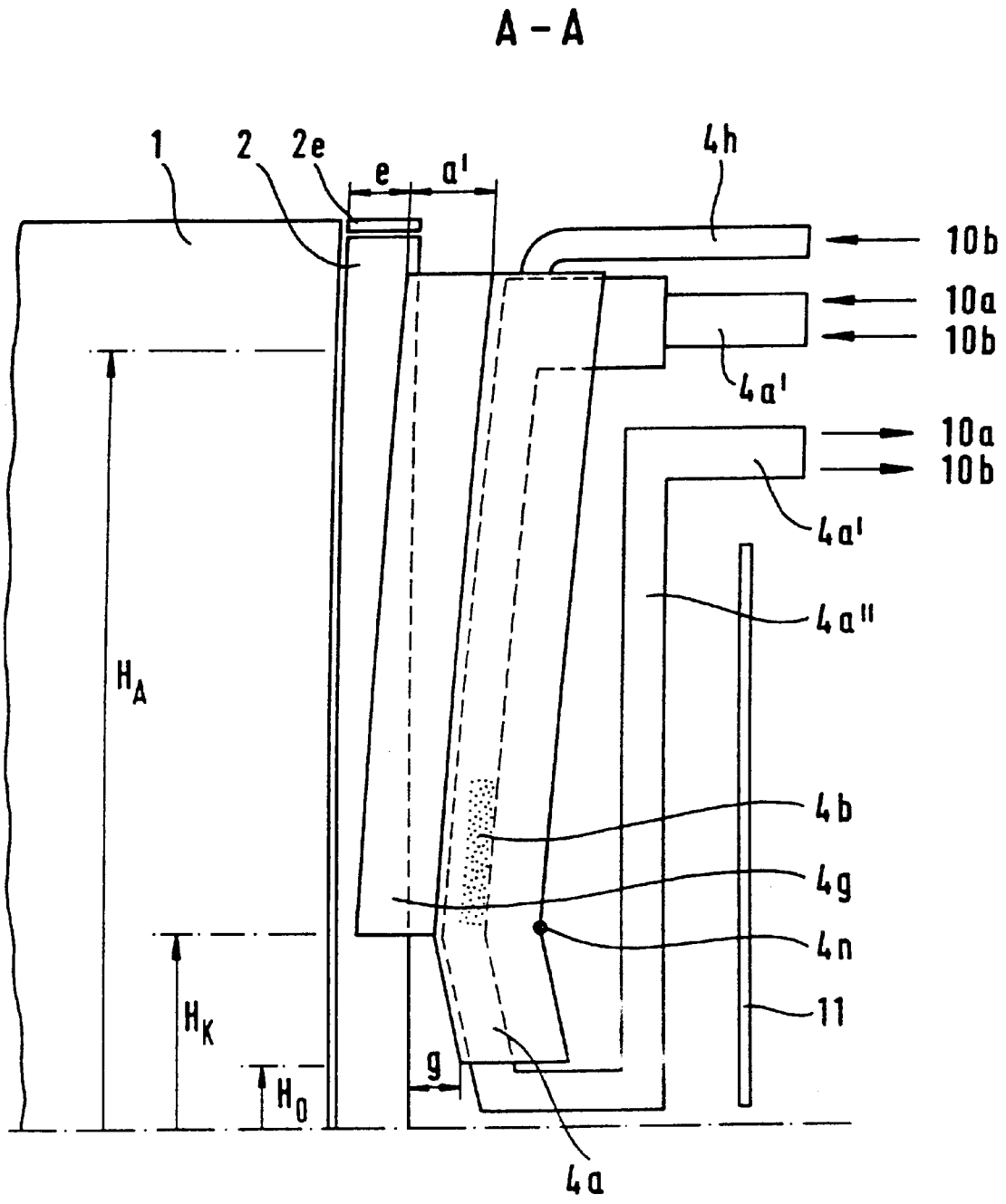
FIG. 6 shows a longitudinal section of a roll end and a sealing device according to the present invention.

Current tube 4*a,* for example, a rectangular copper tube, has an active part 4*a* that is arranged from the inside in the inductor (cf. FIG. 5) and a feed part 4*a″* on the rear side (cf. FIGS. 1 and 6). Inner active part 4*a* is composed of two sections, two lower rectilinear tubes which are soldered together, and two upper tubes, which basically constitute circular curves (FIG. 5). Medium-frequency current 10*a* and cooling water 10*b* are conducted into the active part of current tube 4*a* via current tube connections 4*a′*.

The magnetic yoke is primarily composed of rectilinear yoke part 4*c* and (circular) arched yoke part 4*d*. The cross-section of part 4*d* is asymmetrical. The inner magnetic web is longer by a length of yoke tooth 4*e,* i.e., longer by a' (FIG. 8). The length of yoke tooth a' has the same order of magnitude as the length of the casting-roll magnetic end ring, that is to say, a'≅a.

The supplementary parts of the yoke are:

magnetic shoe 4*g,* which is located on magnetic-shoe cooling plate 4*b* between the current tubes, and magnetic wedge 4*f,* which, on the one hand, counteracts distension of laminate stacks 4*c* and 4*d* and, on the other hand, reinforces magnetic flux at the height of the magnetic shoe.

The magnetic yoke is produced from thin magnetic laminations—like casting-roll magnetic end ring 2. Parts 4*f* and 4*g* may also be made of powdered material (for example ferrite) with high temperature capability. An insulating layer, e.g., a ceramic layer applied by plasma spraying, is applied to the magnetic yoke from the inside and outside.

The magnetic yoke is located in the immediate vicinity of the liquid metal and requires cooling via water-cooled current tubes 4*a,* via cooling plate 4*c,* via tooth-cooling tube 4*h*.

Located between yoke teeth 4*e* is fire-proof plate 4*i*. Resting on plate 4*i* is an electrically conductive heating plate 4*k*, see FIGS. 5 and 8, which is heated by the stray magnetic flux from current-tube return conductor 4*a″*. Located between fire-proof plate 4*i* and thermally-insulating plate 41 is a temperature-setting chamber 4*j* having temperature measuring sensors 4*j′*, tooth-cooling tubes 4*h,* and electrically conductive heating plate 4*k*.

The necessary temperature of the components is set with the aid of these elements. On the one hand, fire-proof plate 4*i* must be sufficiently hot from the inside, so that liquid metal 3 does not solidify on it; on the other hand, the temperature of the magnetic yoke, in particular of yoke tooth 4*e* and of magnetic shoe 4*g,* must not exceed the Curie temperature (e.g. 760° C.).

Eddies in liquid metal 3 in the pool between casting rolls 1 are undesirable, and therefore should not be produced by the sealing device/inductor.

Figure 3:
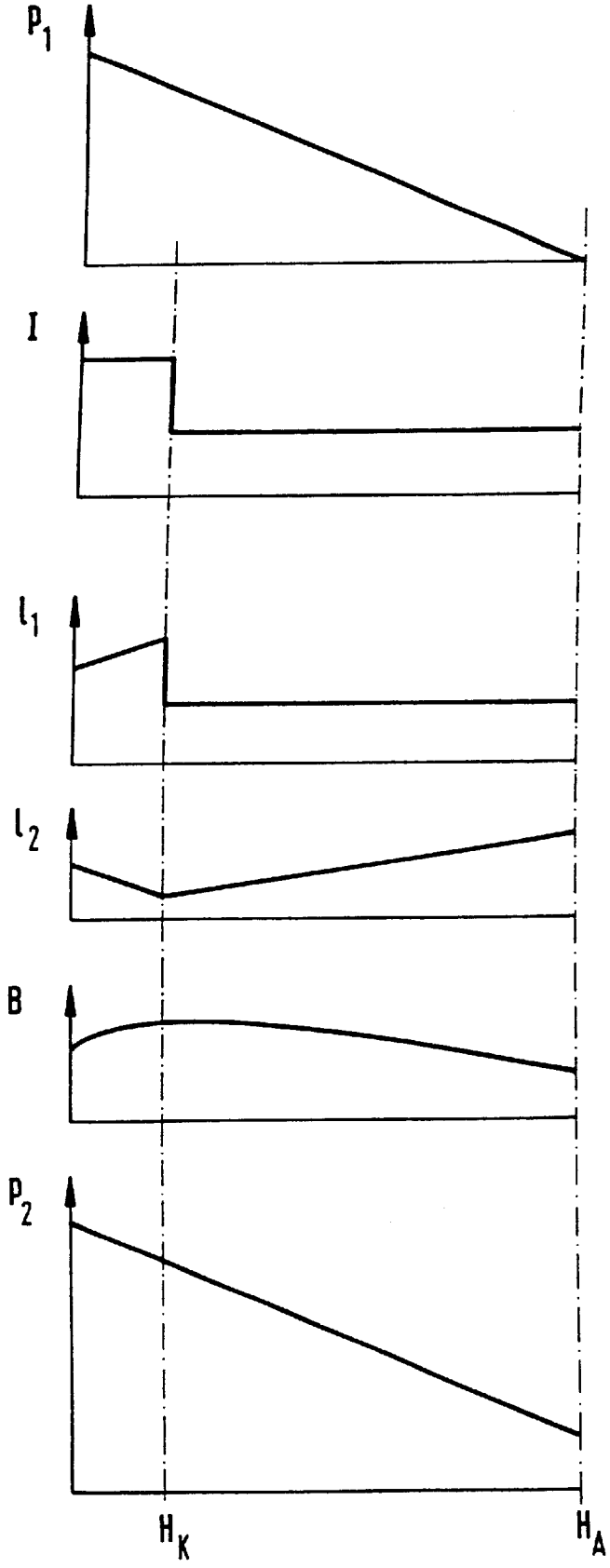
FIG. 3 shows sealing parameters over a height of a liquid metal between casting rolls according to the present invention.

The hydrostatic pressure on side wall $P_1$ runs rectilinearly at the height of the liquid metal between the casting rolls (curve for $p_1$ in FIG. 3). In order to achieve sealing which is substantially free of eddies, according to the present invention, electrodynamic pressure $p_2$ is set so that it has the most rectilinear characteristic possible over the height of sealing gap B, for example as illustrated in FIG. 3, curve $p_2$.

The inductor sealing current I has a characteristic over the height of the liquid metal between the casting rolls such as is illustrated in FIG. 3, curve for I. Below and above critical height $H_k$ it is constant, but of different magnitude.

Given a predefined characteristic of inductor sealing current I, as in the curve for I in FIG. 3, the characteristic of sealing gap B that is necessary for a linear characteristic of electrodynamic pressure $p_2$, as in the curve for sealing gap B in FIG. 3 (root function), is achieved via an appropriate setting of an air path, according to the present invention.

To this end, according to the present invention, the inductor has a bend 4*n* at height H*k* (critical height). The inductor current is set, with the aid of the inductor supply voltage, in such a way that at height $H_k$, it generates the desired electrodynamic pressure $p_2$. For the exemplary configuration, it is assumed that this pressure settles at an induction B=1T.

Given an inductor without bend 4*n*, pressure $p_2$ would be too large below and above $H_k$. Consequently, liquid metal would flow in the direction of the center of the pool. At heights $H_A$ and $H_o$, where the smallest electrodynamic pressure occurs in each case, these flows would return to the side wall. The circulating liquid metal would describe a figure eight with its movement at each of the roll ends.

However, because of bend 4*n* according to the present invention, the outer ends of magnetic yoke 4*c* and 4*d* are distanced from the roll end. Hence, the air path of the magnetic lines is increased, which leads to the reduction of sealing gap B and ultimately electrodynamic force of $p_2$.

At height $H_o$, i.e., C—C (FIGS. 4 and 7), the distance between the two casting-roll magnetic end rings 2 is equal to length i and is significantly smaller than that at height $H_k$, where an induction B=1T was set/assumed.

Without the bend according to the present invention in the inductor, the induction would be around 2T in the case of an industrially effective arrangement. Since the electrodynamic pressure is proportional to $B^2$, it would therefore be almost 4 times greater at height C—C than at height $H_k$. However, a significantly smaller pressure is needed here for eddy-free sealing, for example:

$$p_2=1.2\ p_k$$

where $p_2$ is the electrodynamic pressure at height C—C and $p_k$ is the electrodynamic pressure at height $H_k$.

Given the pressures assumed above, the induction at height C—C should be $$B_2=\sqrt{1.2}\cdot B=\sqrt{1.2}\cdot 1\text{T}.$$

This means that an induction around 3 times smaller is needed. The necessary induction is achieved, set by way of the suitable selection of distance g in FIG. 7.

At height D—D (FIG. 8), $p_1$ is relatively small, thus $p_3$. (the electrodynamic pressure at this height) must also be correspondingly low, for example $p_3=0.3\ p_k$, then $$B_3=\sqrt{0.3}\cdot B=\sqrt{0.3}\cdot 1\text{T}.$$

The induction is reduced again by enlarging the air path, here to distance g' (FIG. 8).

In the case of an inductor design having rectilinear yokes in longitudinal section, as in FIG. 6, achieving the characteristics for B and $p_2$ in FIG. 3 is only approximately possible. In order to generate a B curve which would produce an exactly rectilinear $p_2$, an inductor that is bent in the longitudinal section would be necessary.

The geometry of sealing channel 8 and the magnetic lines are fundamentally different below and above $H_k$. Their influence on the sealing process is explained at the two selected heights:

Height C—C (FIG. 7)

The magnetic flux produced by the inductor is illustrated by two magnetic lines. The main magnetic flux is completed between the two casting-roll magnetic end rings 2. It is illustrated by line 6*a*. At the assumed induction $B=B_2$, the liquid metal is completely expelled from sealing channel 8. This channel thus remains free of liquid metal.

Liquid-metal meniscus 7*a* is maintained by the split flux, which is illustrated by line 6*b*. The split flux traverses the meniscus and, in interaction with the current induced there, generates electrodynamic pressure $p_2$.

Liquid-metal meniscus 7*a* reaches into sealing channel 8, a few millimeters beyond the casting roll end.

Height D—D (FIG. 8)

The main magnetic flux is illustrated by line 6*a*. Its path is completed between yoke tooth 4*e* and casting-roll magnetic end ring 2, specifically between the explanatory points 9*b* and 9*a*, which are drawn as small circles in FIGS. 4 and 8. This flux traverses sealing channel 8 and makes it free of liquid metal.

The magnetic split flux is illustrated by line 6*b*. Its path is completed through liquid-metal meniscus 7*b*, which here, as at the entire sealing height, projects into the sealing channel only a few millimeters beyond the casting-roll end. The magnetic split flux is lower at height D—D than at height C—C, but the hydrostatic pressure of liquid metal 5 in the pool is also lower.

The depth of sealing channel 8 is fundamentally determined by length a of casting-roll magnetic end ring 2. It may be 20 mm, for example. The distance of the temperature-sensitive inductor from the hot (1500° C.) liquid metal meniscus is increased by this length. It is only distance a that is free of liquid metal that makes it technically possible to implement the inductor.

Sealing channel 8 can be traversed by inert gas which, on the one hand, protects the inductor thermally and, on the other hand, rules out any oxidation of the liquid-metal meniscus, of the edge of the strip.

Flowing in current return conductor 4*a*″ is a strong medium-frequency current, for example 5 kA. It will produce its own magnetic field.

The inductor (in particular the lower half of its rear side) is located in the immediate vicinity of ferromagnetic steel elements of the roll stand. The medium-frequency magnetic field would complete a magnetic path through these and warm them up inductively, heating them unacceptably at some points.

In order to protect the steel elements of the roll stand, shielding plate 11 is placed between inductor 4 and the steel elements, and the plate is cooled with the aid of a cooling-water tube, if necessary.

Conventional design approaches for electromagnetic side-wall seals relate to the electrodynamic sealing of the entire side wall between the casting rolls. It is already the case with relatively small casting rolls having a diameter of 1 meter that, in order to seal off the liquid metal close to the surface, magnetic fluxes have to be driven through an air path that is about 50 cm long, which requires enormous currents and powers, in particular reactive powers.

In the design approach of the present invention, in which only the sealing gap having a width of, for example, 1 cm has to be magnetized, the necessary reactive power proves to be significantly less. In a first approximation, the result is that it only $$2\cdot\frac{1\text{ cm}}{50\text{ cm}}\cdot 100\% = 4\%$$

(factor 2, because 2 inductor curves) of the reactive power of conventional design approaches.

Sealing experiments were carried out with a test device, which corresponded to a roll stand having casting rolls with a diameter of 1 m. The liquid metal used had a density of 8.5 g/cm$^3$. The density was therefore greater than in the case of steel.

Good sealing at a height of the liquid metal of 30 cm was achieved with:

| | |
|---|---|
| feed frequency | 1.4 kHz |
| total inductor current | 5.13 kA |
| inductor voltage | 33 V |
| an effective power | <30 kW |

What is claimed is:

1. A device for casting strips of metal, comprising:

counter-rotating casting rolls;

two side walls, liquid metal being fed into a space between the casting rolls bounded by the two side walls, gaps being formed between the side walls and the casting rolls; and a sealing device sealing each of the gaps, the sealing device generating electrodynamic forces which follow a profile of the gaps and act parallel to surfaces of the casting rolls, the sealing device including a Y-shaped current-carrying inductor having two branches above a base, the inductor being arranged at an axial end of said rolls and having a spacing in the axial direction of said rolls between said axial ends and said inductor, the inductor being configured such that said spacing in the axial direction of said rolls increases from an intersection of said branches and said base, toward both top ends of said branches and toward a bottom end of said base, thereby providing electrodynamic forces on said liquid metal which are continuously adapted to metallostatic pressure of the liquid metal.

2. The device according to claim 1, wherein the metal is steel.

3. The device according to claim 1, wherein the inductor is an integral unit.

4. The device according to claim 1, wherein the sealing device includes magnetizable material.

5. The device according to claim 4, wherein the sealing device further includes a magnetic shoe made of the magnetizable material, the magnetic shoe being arranged so that the electrodynamic forces are adapted continuously to the metallostatic pressure of the liquid metal.

6. The device according to claim 4, wherein the magnetizable material is arranged at edges of the inductor.

7. The device according to claim 1, wherein the sealing device includes a water-cooling system.

8. The device according to claim 7, further comprising:

a sealing channel, the sealing channel being an interspace between the sealing device and the liquid metal, an inert gas flowing through the sealing channel, the inert gas including nitrogen.

9. A method for casting strips of metal, comprising the steps of:

feeding liquid metal into a space between counter-casting rolls, the space being bounded by two side walls; and sealing gaps formed between the two side walls and the rotating casting rolls using a sealing device, the sealing device including a Y-shaped current-carrying inductor having two branches and a base, the sealing including arranging the inductor at axial ends of said rolls with a spacing in the axial direction of said rolls between said axial ends and said inductor, the arranging being such that said spacing in the axial direction of said rolls increases from an intersection of said branches and said base, toward both top ends of said branches and toward a bottom end of said base;

generating electrodynamic forces using said inductors, the electrodynamic forces acting along the gaps and parallel to surfaces of the casting rolls, and adapting the electrodynamic forces continuously to a metallostatic pressure of the liquid metal.

10. The method according to claim 9, further comprising the step of:

producing a metal strip.

11. The method according to claim 9, further comprising the step of:

producing a steel strip.

12. A device according to claim 6 wherein the sealing device is arranged non-parallel to the casting rolls.

13. A device according to claim 5, wherein said magnetic shoe, when looking in the direction of said axes of said casting rolls, is one of V-shaped and Y-shaped.

14. A device according to claim 1, wherein said inductor has a bend in a region near said intersection.

15. A device according to claim 1, wherein said inductor is curved in its longitudinal direction.

16. A device according claim 5, wherein the amount of magnetizable material decreases in the direction of the ends of said magnetic shoe.

17. A device according to claim 5, wherein said magnetic shoe in the region of said branches has an inner arm and an outer arm, said arms extending in the direction of said axes of said rolls, said inner arm being situated in a spacing between said branches, said outer arm being situated outside said spacing, said inner arm and outer arm being configured different from each other.

18. A device according to claim 16, wherein said inner arm is longer than said outer arm in the direction of said axes.

19. A device according to claim 18, wherein difference in length between said inner and outer arm is approximately equal to a length in the direction of said axes of a magnetic end ring arranged at an axial end of none of said rolls.

* * * * *